US005393972A

United States Patent [19]

Suyama et al.

[11] Patent Number: 5,393,972

[45] Date of Patent: Feb. 28, 1995

[54] IMAGING DEVICE WITH HIGH SPEED SHUTTERING

[75] Inventors: Motohiro Suyama; Katsuyuki Kinoshita, both of Hamamatsu, Japan

[73] Assignee: Hamamatsu Photonics K.K., Hamamatsu, Japan

[21] Appl. No.: 54,027

[22] Filed: Apr. 29, 1993

[30] Foreign Application Priority Data

Apr. 30, 1992 [JP] Japan ..... 4-111410
Mar. 1, 1993 [JP] Japan ..... 5-039860

[51] Int. Cl.[6] ..... H01J 31/50
[52] U.S. Cl. ..... 250/214 VT; 313/537
[58] Field of Search ..... 250/214 VT; 313/528, 313/529, 532, 537, 524–526

[56] References Cited

U.S. PATENT DOCUMENTS 3,633,478 1/1972 Ishimatsu ..... 250/214 VT
3,796,901 3/1974 Mayer et al. .
3,934,170 1/1976 Enck, Jr. et al. .
4,740,685 4/1988 Koishi ..... 313/537
4,801,796 1/1989 Kinoshita et al. ..... 313/529
4,926,039 5/1990 Garfield et al. ..... 250/214 VT

FOREIGN PATENT DOCUMENTS 0315435 5/1989 European Pat. Off. .
1564698 4/1969 France .
2171553 8/1986 United Kingdom .

OTHER PUBLICATIONS

Stoudenheimer et al., "An Image-Converter Tube for High-Speed Photographic Shutter Service", RCA Review, vol. 18, No. 3, Sep. 1957, pp. 322–331.

*Primary Examiner*—David C. Nelms
*Assistant Examiner*—Stephone B. Allen
*Attorney, Agent, or Firm*—Cushman Darby & Cushman

[57] ABSTRACT

An object of this invention is to provide an imaging device which can output distinct images which are not blurred. According to this invention, photoelectrons emitted from a photocathode (2) during a gate period in which a low potential change is given to the photocathode have set energy different from that of photoelectrons during the other period, and are incident on an energy filter (9). Only photoelectrons of the set energy pass through the energy filter (9). The photoelectrons which have passed through the energy filter during a gate period advance to an output surface (3).

9 Claims, 22 Drawing Sheets 1
2
3
4
5
6
8
9
91
92
L1
L2
5kV
8.6kV
9.5kV
10.005kV
-8.6kV
-10kV
10
Power Source

IMAGING DEVICE WITH HIGH SPEED SHUTTERING

BACKGROUND OF THE INVENTION

1. Field of the Invention

This invention relates to an imaging device using an electron tube which is capable of high-speed shuttering.

2. Related Background Art

As the prior art relevant to the imaging device according to this invention, the imaging devices as shown in FIGS. 1 and 2 are known. FIG. 1 is a sectional view of a photocathode gate-type imaging device. A vacuum vessel 201 includes a light detecting plate on which a photocathode 202 is formed, an output plate on which a fluorecent surface film 203 is formed, and a microchannel plate (MCP 204) located between the light detecting plate and the output plate for performing multiplication of electrons input thereto.

In this imaging device, when a gate voltage is applied to the photocathode 202, changed from 0 V to −200 V with bias voltages respectively applied +4.9 KV and +0.9 KV to the fluorescent surface film 203 and the MCP 204, a shuttering operation is conducted during a gate period in which the applied voltage is kept to be −200 V, and only during a gate period in which the applied voltage is kept to be −200 V, an image is obtained. That is, only during the gate period ($T_G$), the photoelectrons emitted from the photocathode 202 reach the MCP 204, and an image corresponding to the gate period ($T_G$) is formed.

FIG. 2 is a sectional view of an MCP gate-type imaging device. A vacuum vessel 201 includes an acceleration grid 205, an electron lens 206, a deflecting electrodes 207*y*, 207*x*, and grounded anodes 208, 209. In this imaging device, deflecting voltages are respectively applied to the deflecting electrodes 207*x*, 207*y* so that framing images are formed.

When a voltage is applied to the MCP 204 between both ends thereof, changed from 0 V to +800 V, photoelectrons are multiplied only during a gate period in which the applied voltage is kept to be +800 V. As in such photocathode gate-type imaging device, high-speed shuttering operation can be realized.

SUMMARY OF THE INVENTION

This invention relates to an imaging device for forming an image of an object to be imaged at a set shutter timing comprising a photocathode for emitting photoelectrons in accordance with incident light for the object to be imaged, an acceleration electrode of electron-transmitting type opposed to the photocathode and having a positive potential with respect to the photocathode, power source means for changing a photocathode potential in a set range from a constant level in synchronization with the shutter timing, an energy filter disposed on the opposite side of the photocathode across the acceleration electrode for blocking photoelectrons from the photocathode at said constant level, and passing photoelectrons emitted from the photocathode when said photocathode potential is changed by a required value within said set range, and an output surface for the photoelectrons which have passed through the energy filter to be incident on.

According to the imaging device of this structure, photoelectrons emitted from the photocathode during a gate period in which a small potential change is given have set energy which is different from that of photoelectrons emitted in a period other than gate period, and are incident on the energy filter. Thus only the photoelectrons of the set energy pass through the energy filter to the output surface.

Here by providing the energy filter by a high-pass filter, only photoelectrons of higher energy than constant energy pass through the energy filter. By providing the energy filter by a high-pass filter and a low-pass filter, only photoelectrons of energy between the higher and the lower constant levels pass through the energy filter.

This invention relates to an imaging device for forming an image of an object to be imaged at a set shutter timing comprising a photocathode applied with a constant potential for emitting photoelectrons corresponding to incident light from the object to be imaged, an electron transmitting-type acceleration electrode disposed opposite to the photocathode, power source for changing a voltage to be applied to the said acceleration electrode within a set range between a first level and a second level in synchronization with the shutter timing an anode with a constant positive potential to the photocathode, an energy filter disposed on the opposite side of the photocathode across the acceleration electrode for transmitting photoelectrons emitted from the photocathode only while the applied voltage to the acceleration electrode is on increase or decrease, and an output surface for photoelectrons which have been passed through the energy filter to be incident on.

According to the imaging device of such structure, photoelectrons emitted from the photocathode while a voltage applied to the acceleration electrode by the power means is on increase have higher energy than photoelectrons emitted from the photocathode while the applied voltage to the acceleration electrode is not changed. Photoelectrons emitted from the photocathode while the applied voltage to the acceleration electrode is on decrease have lower energy than photoelectrons emitted from the photocathode while the applied voltage to the acceleration electrode is not changed. The energy filter passes photoelectrons of different energy from that of photoelectrons emitted from the photocathode while the applied voltage to the acceleration electrode is not changed, whereby only the photoelectrons emitted from the photocathode while the applied voltage to the acceleration electrode is changed can pass through the energy filter.

This invention relates to an imaging device for forming an image of an object to be imaged at a set shutter timing comprising a photocathode for emitting photoelectrons in response to incident light of the object to be imaged, a acceleration electrode of photoelectron transmitting type for acceleration disposed opposed to the photocathode, power source means for changing a potential of the photocathode from a constant level within a set range in synchronization with said shutter timing, a first electron lens system for converging the photoelectrons accelerated by the acceleration electrodes, energy analyzing means of sector divided spheres including two divided-spherical electrodes having different radii and a common center for passing the photoelectrons converged by the first electron lens system to disperse the photoelectrons corresponding to energies, an opening disposed on the exit of the sector divided spherical energy analyzing means for passing photoelectrons along a set orbit, a second electron lens system for forming an image of the photoelectrons which have passed through the opening, and an output surface for outputting a photoelectronic image formed by the second electron lens system, the first electron lens system being so arranged that one focal point and a position at which a virtual image of the photoelectrons emitted from the photocathode is formed are brought into agreement with each other, while bringing the other focal point and an object point of an electron lens constituted by the sector divided spherical energy analyzing means into agreement with each other, the second electron lens system is so arrange that one focal point and an image point of an electron lens constituted by the sector divided spherical energy analyzing means into agreement with each other, while the other focal point and a position where the output surface is disposed into agreement with each other.

The first electron lens system the sector divide spherical energy analyzing means, and the second electron lens system are so arranged that an output image formed on the output surface is not blurred.

According to the imaging device of this structure, in accordance with a potential of the photocathode which is variable in synchronously with a shutter timing, photoelectrons on a plurality of orbits emitted from the photocathode are incident on the sector divided-spherical energy analyzing means with different energy levels corresponding to their times. The incident photoelectrons are dispersed by the sector divided-spherical energy analyzing means for the respective energy levels, and only photoelectrons of set energy pass through the opening in the exit thereof and form an image on the output surface.

The exit may have a plurality of openings. In this case, deflecting electrodes are provided for the respective openings for applying voltages to the deflecting electrodes so that photoelectrons which have passed through the openings are directed substantially to the center of the second electron lens system. The provision of a plurality of openings in the exit enables a plurality of photoelectronic images to be formed on the output surface at different shutter timings.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF PREFERRED EMBODIMENTS

Embodiments according to this invention will be explained with reference to the drawings attached hereto.

Figure 3:
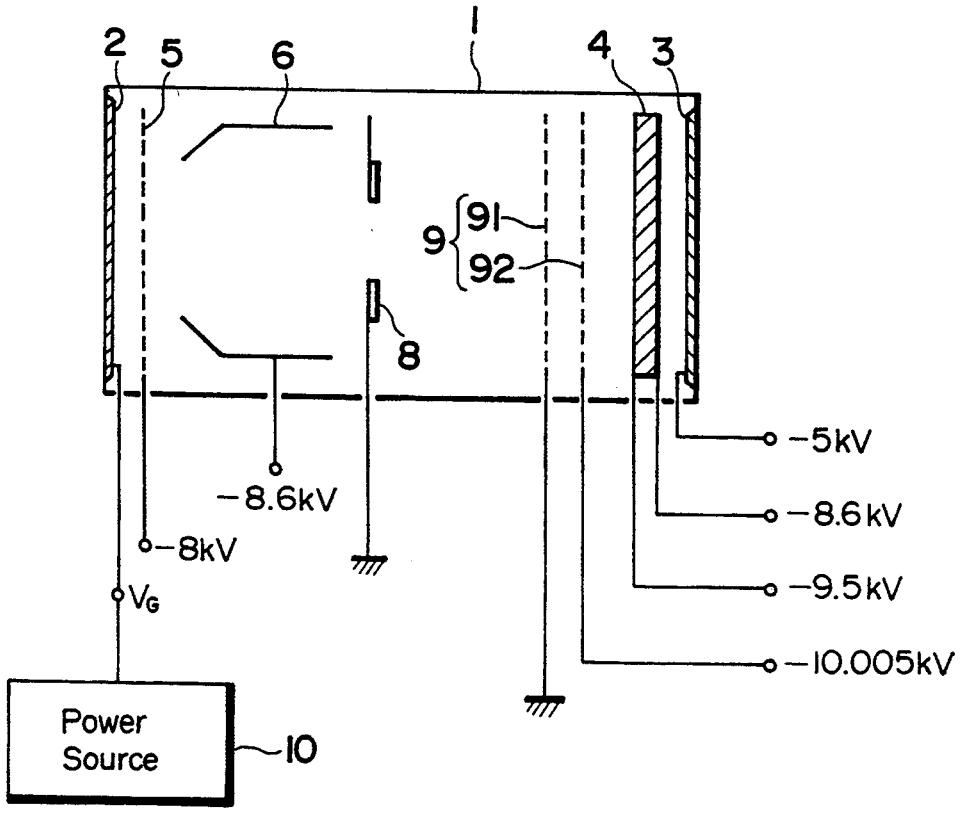
FIG. 3 is a sectional view of the imaging device according to a first embodiment of this invention.

FIG. 3 is a sectional view of the imaging device according to a first embodiment of this invention. As shown in FIG. 3, a photocathode 2 is formed on the inside of one of the plates of a cylindrical vacuum vessel 1, and a fluorescent surface 3 is formed on the inside of the other plate. In the vacuum vessel 1 there are further provided an acceleration electrode 5 for accelerating photoelectrons emitted from the photocathode 2, a focusing electron lens 6 for forcusing the accelerated photoelectrons, and an anode 8 for accelerating the photoelectrons which have passed through the focusing electron lens 6. The vacuum vessel 1 further accommodates a high-pass energy filter 9 for passing only those of higher energy of the photoelectrons which have passed through the anode 8, and an MCP 4 for multiplying the photoelectrons which have passed the energy filter 9.

Figure 4:
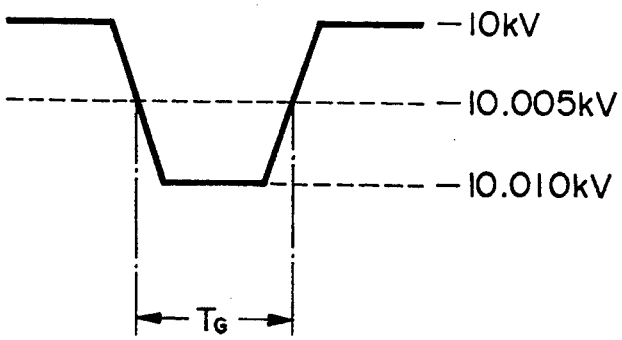
FIG. 4 is a view of changes of a gate voltage to be applied to the photocathode.

Outside the vacuum vessel 1 there is provided a power device 10 for applying a gate voltage $V_G$ to the photocathode 2. As shown in FIG. 4, the gate voltage $V_G$ changes between $-10$ kV and $-10.010$ kV, The acceleration electrode 5 is supplied with a −8 kV voltage. The focusing electron lens 6 is supplied with a −8.6 kV. A voltage from −9.5 to −8.6 kV is applied across the MCP 4. The fluorescent surface 3 is supplied with a −5 kV voltage. The anode 8 is grounded.

The energy filter 9 includes a first grounded mesh electrode 91 facing to the photocathode 2, and a second mesh electrode 92 facing to the fluorescent surface 3. The second mesh electrode 92 is supplied with a −10.005 kV bias.

In the above-described structure, photoelectrons emitted from the photocathode 2 during a period in which a gate voltage $V_G$ (i.e. photocathode potential) is a lower voltage than −10.005 kV, i.e., a gate period $T_G$ have enough energy to pass through the first and the second mesh electrodes 91, 92, multiplied by the MCP 4, and form an image on the fluorescent surface 3. Photoelectrons emitted from the photocathode 2 in a period other than the gate period $T_G$ cannot pass through the energy filter 9 because photocahode potential is higher than the second mesh element potential. A condition on which the energy filter 9 correctly functions is $$E_C<E_F<E_C+E_B$$

where a potential difference between the first and the second mesh electrodes 91, 92 is represented by $E_F$; a potential of the photocathode 2 during a constant state of a gate voltage $V_G$ is represented by $E_C$; and a change amount of the gate voltage $V_G$ is represented by $E_B$. This embodiment satisfies the above condition. Accordingly with a voltage between the photocathode 2 and the acceleration electrode 5 is retained at a high voltage of about 2 kV, and under the condition, a shuttering operation can be performed at the gate voltage $V_G$ having a small amplitude of only 10 V. This results in good picture quality and high-speed operation. A source device 10 for generating the gate voltage $V_G$ can have a simple structure.

Figures 5A, 5B:
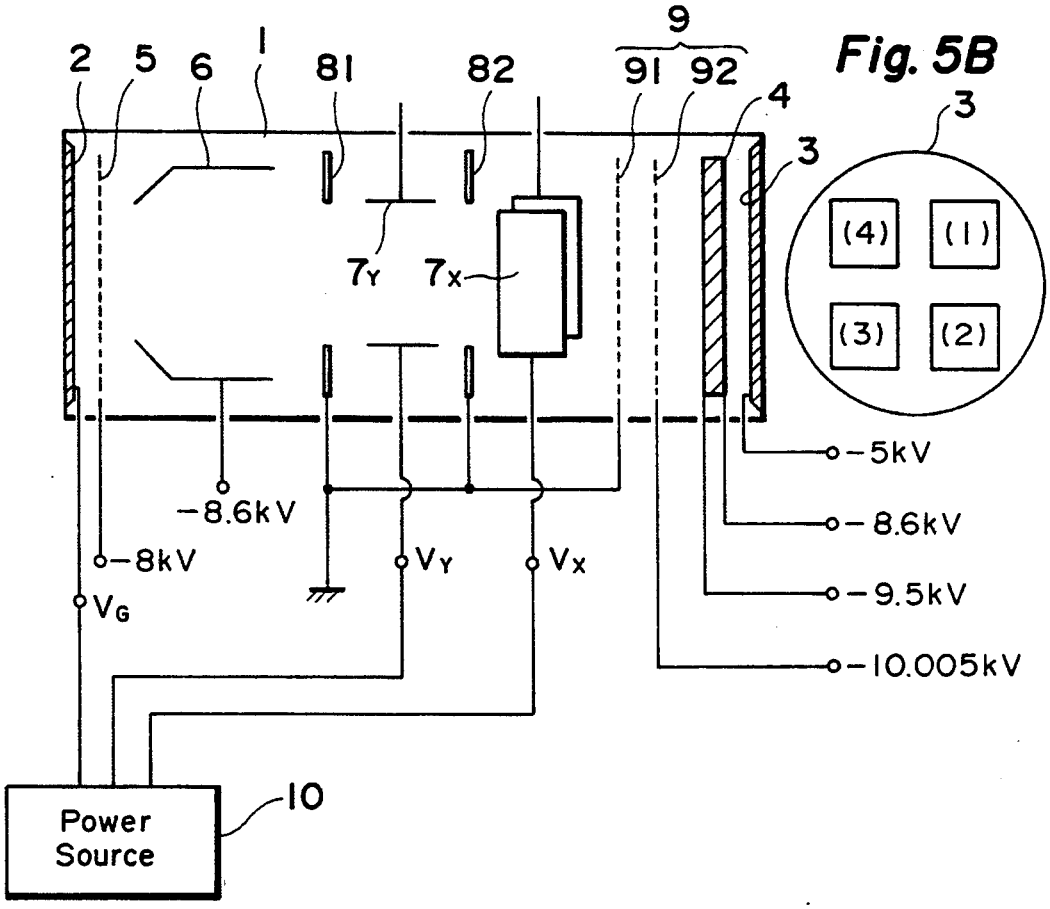
FIG. 5A a sectional view of the imaging device according to a second embodiment of this invention.
FIG. 5B is a view of four framing images according to the second embodiment of this invention.
Figure 6:
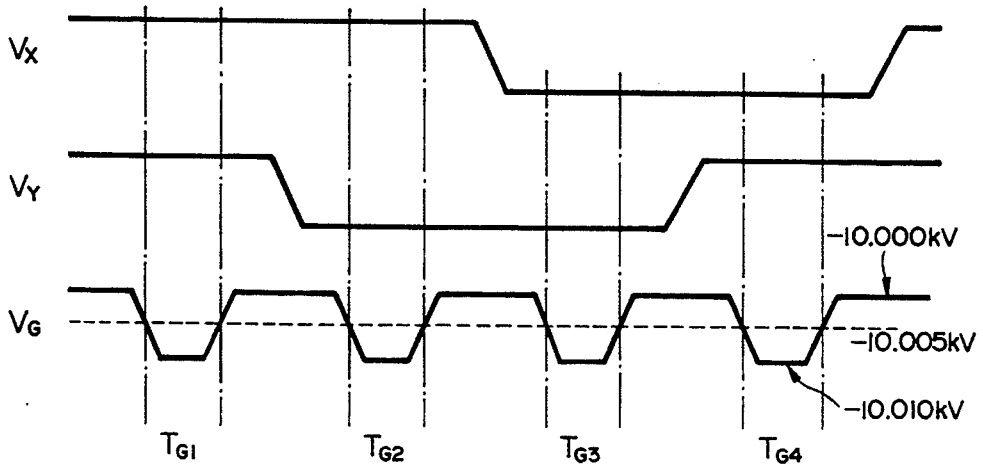
FIG. 6 is a view of changes of voltages to be applied to the photocathode and of deflecting voltages to be applied to the respective deflecting electrodes.

FIG. 5A shows a sectional view of the imaging device according to a second embodiment of this invention. The imaging device according to the second embodiment includes, in addition to the members of the first embodiment, deflecting electrodes 7x, 7y for X and Y deflecting. A photocathode 2 is supplied from a power source 10 with a gate voltage $V_G$ which is changed to −10.010 kV during a gate period $T_{G1}\sim T_{G4}$ shown in FIG. 6. The deflecting electrodes 7x, 7y are supplied with deflecting voltages shown in FIG. 6.

This arrangement allows photoelectrons to pass through an energy filter 9 only during the gate period $T_{G1}\sim T_{G4}$ and deflected by the deflecting electrodes 7x, 7y. As shown in FIG. 5B, framing images (1)∼(4) are formed on the fluorescent surface 3 corresponding to the gate period $T_{G1}\sim T_{G4}$. The gate voltage $V_G$ to be applied to the photocathode 2 has a small amplitude of 10 V which enables high-shuttering operation. A voltage as high as about 2 kV is applied between the photocathode 2 and the acceleration electrode 5, and accordingly picture quality is good.

Figure 7:
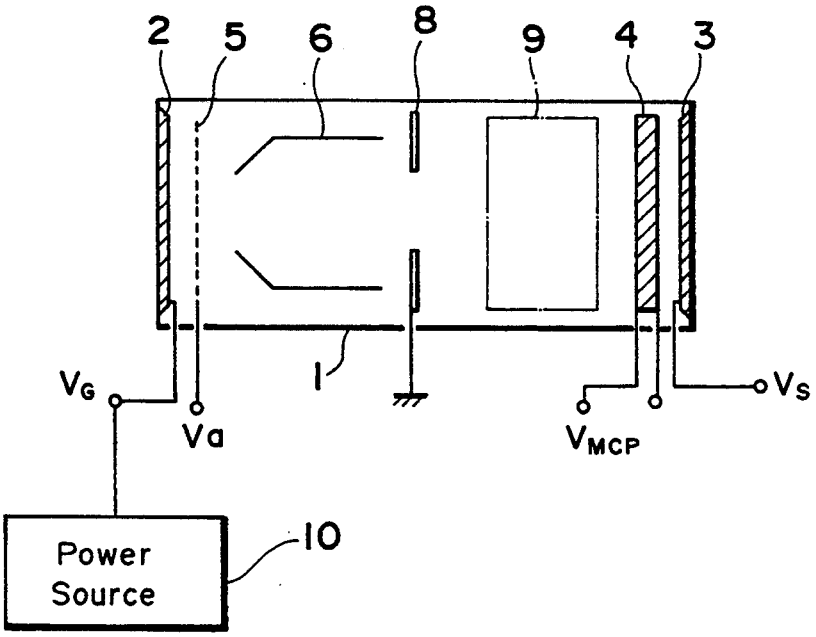
FIG. 7 is a sectional view of the imaging device according to a third embodiment of this invention.
Figure 8:
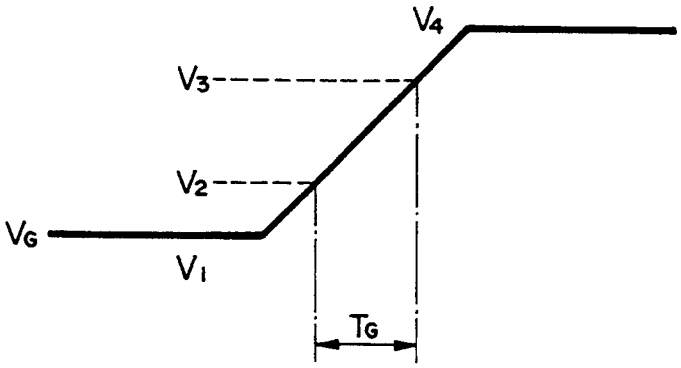
FIG. 8 is a view of changes of a gate voltage to be applied to the photocathode.

FIG. 7 is a sectional view of the imaging device according to a third embodiment of this invention. In this embodiment, an energy pass filter 9 is of a band-pass type. In FIG. 7, an anode 8 is grounded, and a fluorescent surface 3 and an MCP 4 are applied with constant voltage $V_{MCP}$, $V_s$. A acceleration electrode 5 is supplied with a constant negative high voltage $V_a$. The photocathode 2 is supplied from a power source 10 with a gate voltage $V_G$ which changes from one constant voltage $V_1$ to another constant voltage $V_4$ through a middle-level voltages $V_2$, $V_3$ shown in FIG. 8.

The energy filter 9 is disposed between an anode 8 and an MCP 4. The energy filter 9 does not pass either high-energy photoelectrons accelerated by a voltage below the voltage $V_2$ or low-energy photoelectrons which have been accelerated by a voltage above the voltage $V_3$; however, the energy filter 9 selectively passes middle-energy photoelectrons accelerated by a voltage from $V_2$ to $V_3$. That is, the energy filter 9 functions as a band-pass filter for passing the photoelectrons during a time of a gate voltage $T_G$ shown in FIG. 8. The gate voltage $T_G$ is changed only by a small amplitude, and a high shuttering operation can be easily performed during the gate period $T_G$.

Figure 9:
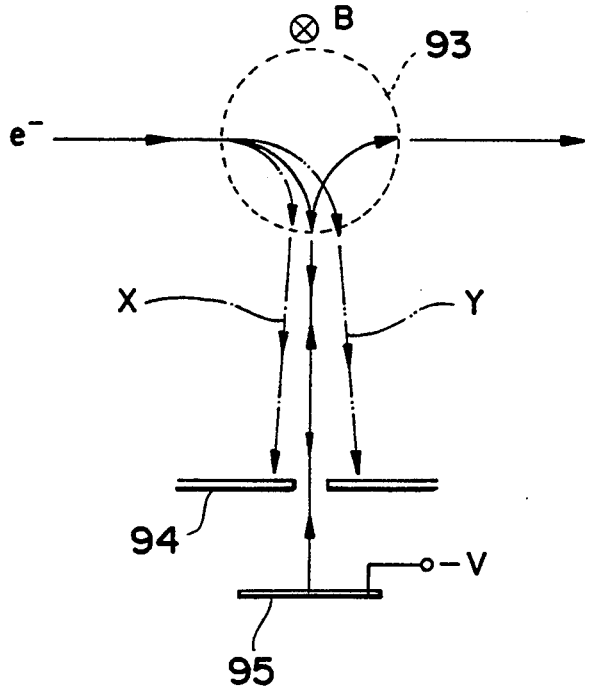
FIG. 9 is a schematic view of one example of the band-pass energy filter.

FIG. 9 shows one example of the band-pass energy filter 9. This energy filter 9 comprises magnetic means 93 for forming a magnetic field (B) for changing a direction of propagation of photoelectrons (−e) , and an aperture 94 for passing a part of the photoelectrons, and a reflection electrode 95 having a −V potential.

Propagation directions of the photoelectrons (−e) are curved by the magnetic field B. Low-energy photoelectrons (X) curve at an acute angle, and high-energy photoelectrons (Y) curve at a blunt angle. Only those of the photoelectrons which have been accelerated by a middle-energy can pass through the opening of the aperture 94. The photoelectrons which have passed through the aperture 94 are reflected on the electrode 95, then again pass through the opening of the aperture 94, curved by the magnetic field B, and emitted rearward of the energy filter 9.

By the use of such energy filter 9, the incoming photoelectrons and the outgoing photoelectrons take the same orbit. Since the shuttering operation is performed at a slope voltage, the shuttering operation can be much speeded up. The slope voltage can be, e.g., 3 kV/200 ps. If a orbit width of the band-pass filter 9 is 3 V, the shuttering period can be 100 fs.

Figure 10:
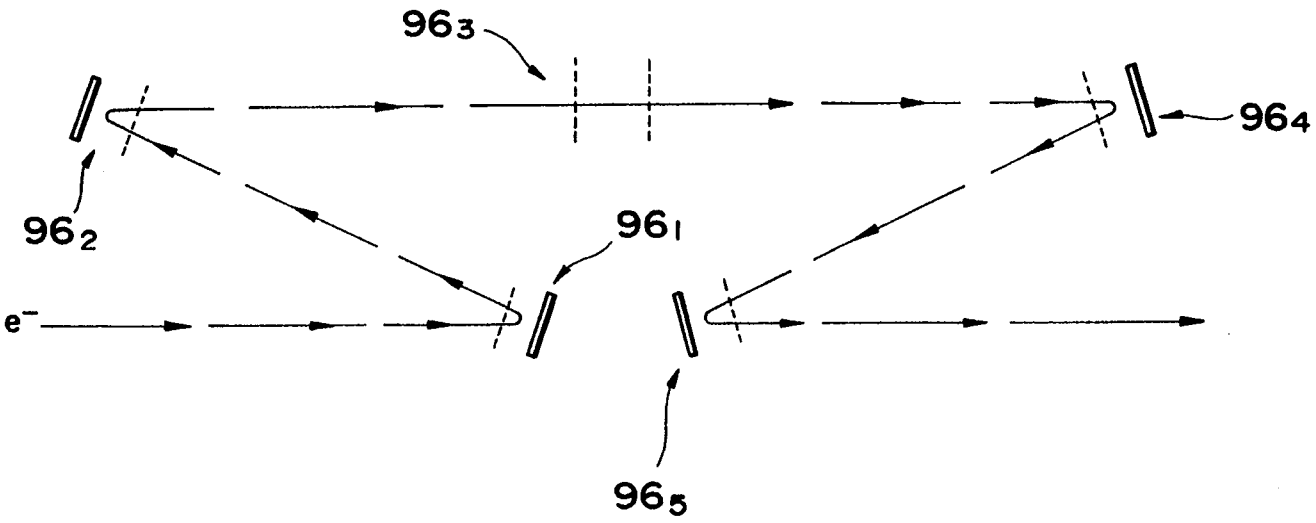
FIG. 10 is a schematic view of another example of the band-pass energy filter.

FIG. 10 shows another example of the band-pass energy filter 9. While incoming photoelectrons are reflected on electrodes $\mathbf{96}_1\sim\mathbf{96}_5$ and propagate, an orbit of outgoing photoelectrons is brought into agreement with an orbit of the incoming photoelectrons. In addition, those of the incoming photoelectrons which has a certain energy range can be extracted. That is, when photoelectrons enter the energy filter 9, high-energy photoelectrons out of the photoelectrons are absorbed on the electrode $\mathbf{96}_1$, the other photoelectrons being reflected toward the next electrode $\mathbf{96}_2$. The electrode $\mathbf{96}_2$ reflects all the photoelectrons, but the further next electrode $\mathbf{96}_3$ absorbs low-energy photoelectrons out of the photoelectrons, admitting the other photoelectrons. Thus, middle-energy photoelectrons out of the incoming photoelectrons are extracted. Then the extracted photoelectrons are totally reflected on the electrodes $\mathbf{96}_4$ and $\mathbf{96}_5$ and outputted rearward along the same orbit as the incoming photoelectrons.

The band-pass energy filter 9 of FIG. 9 is described in "Bunkoh Kenkyu", vol. 27, No. 1 (1978), p. 65–66".

Examples of the energy filter of FIG. 10 are described in "Rev. Sci. Instrum." 57 (8), August, 1986, p. 1494–1500".

Figure 11:
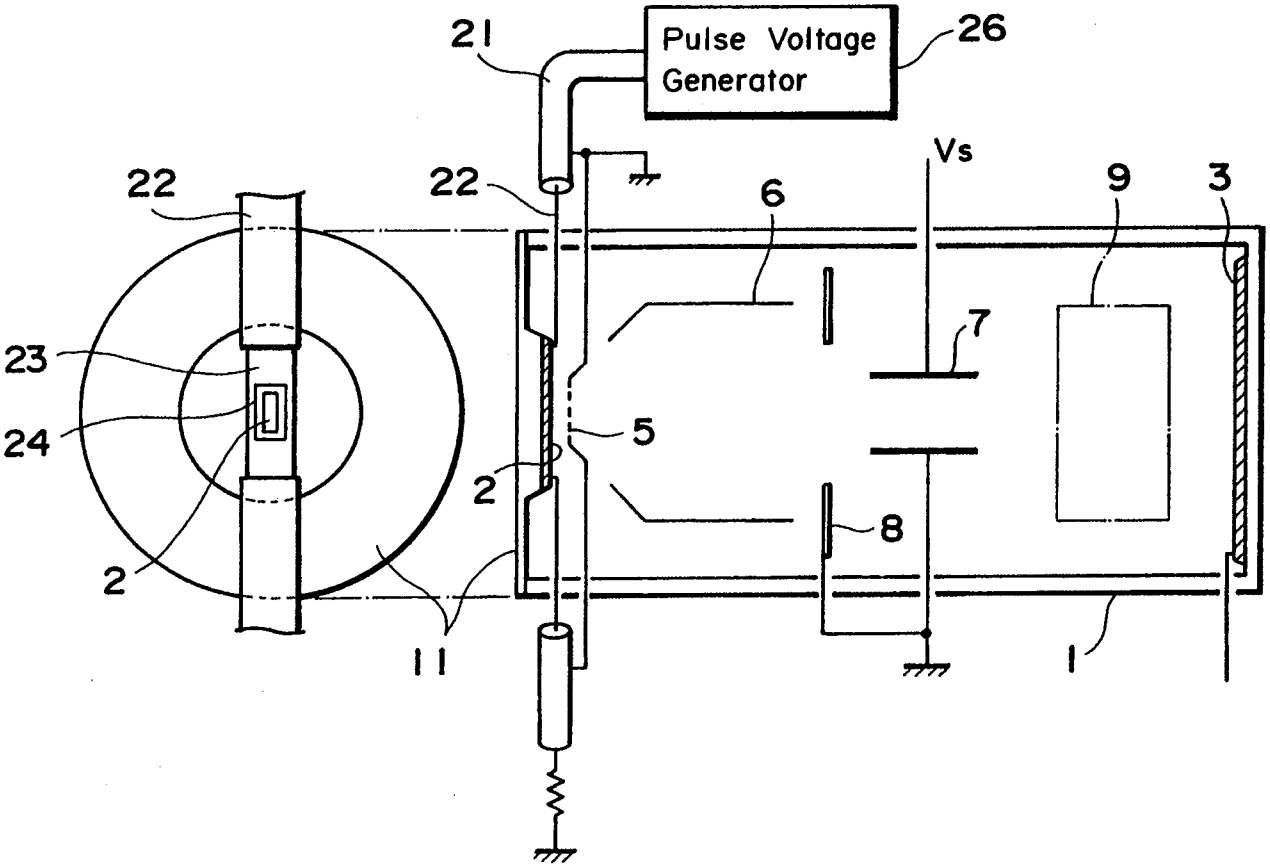
FIG. 11 is a sectional view of the imaging device according to a fourth embodiment of this invention.

FIG. 11 is a sectional view of the imaging device according to a fourth embodiment of this invention. In this embodiment, a photocathode 2 has a strip line structure. A signal line 22 of a coaxial cable 21 is connected to a strip line 23 formed on a light detecting plate 11. A photocathode 2 is formed on the substrate metal film 24 on the strip line 23. The coaxial cable 21 is connected to a pulse voltage generator 26. An acceleration electrode 5 opposed to the photocathode 2 is grounded.

This structure enables a gate voltage $V_G$ to change in a very short period of time. Resultantly a high-speed shuttering operation is enabled. So-called framing images can be formed by applying a deflecting voltage $V_S$ to a deflecting electrode 7 at the same time. An energy filter 9 may be of the high-pass type, low-pass type, or band-pass type.

Figure 1:
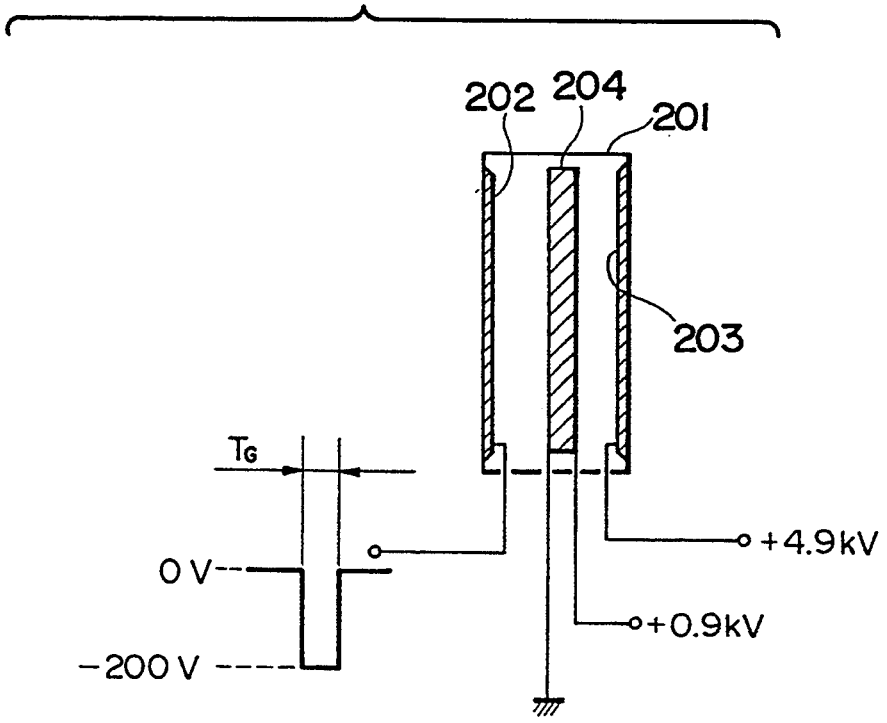
Fig. 1 (PRIOR ART)
FIG. 1 is a sectional view of a conventional imaging device.
Figure 2:
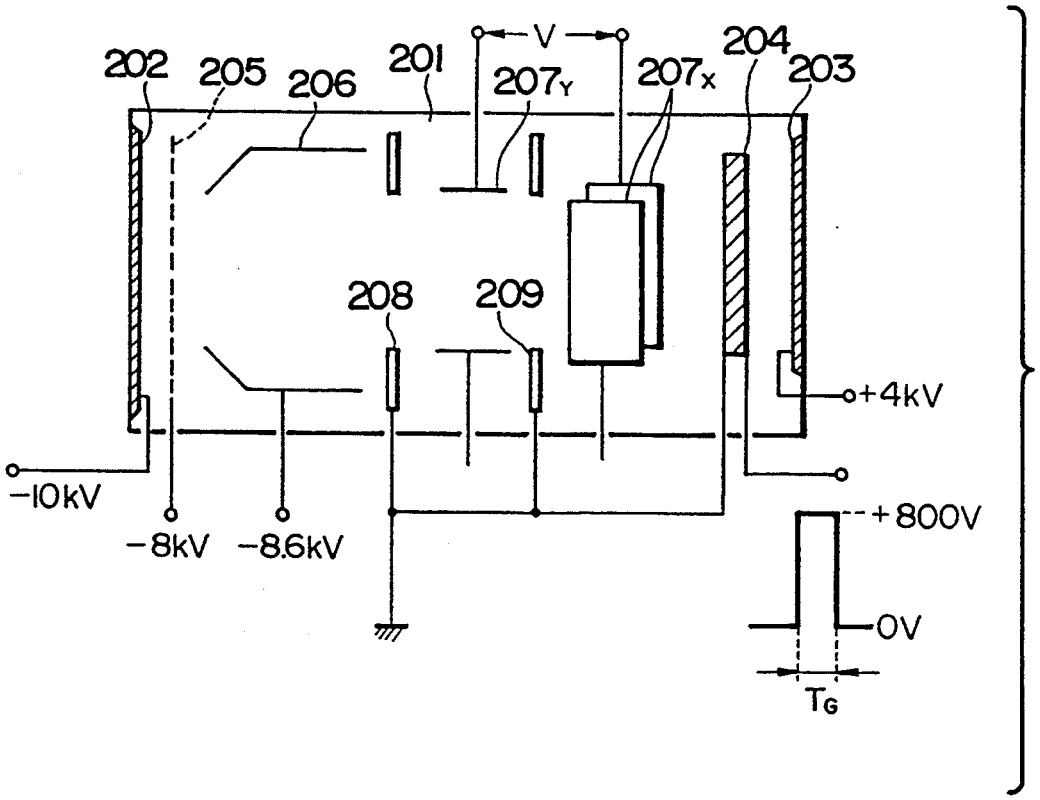
Fig. 2 (PRIOR ART)
FIG. 2 is a sectional view of a conventional imaging device.

The strip line structure of the photocathode 2 of FIG. 11 is described in FIG. 2 of Japanese Patent Laid-Open Publication No. 118539/1992.

Figure 12:
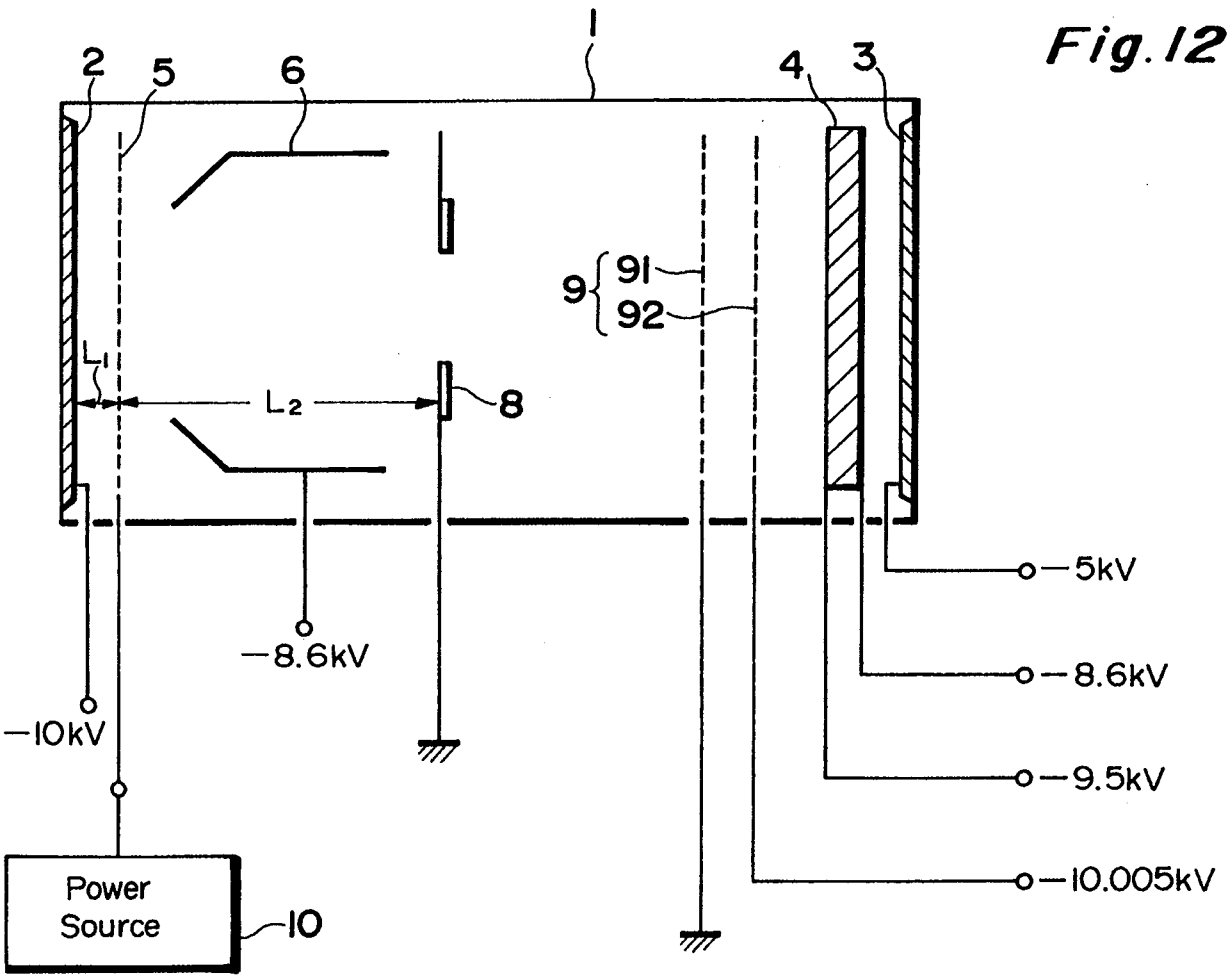
FIG. 12 is a sectional view of the imaging device according to a fifth embodiment of this invention.
Figure 13:
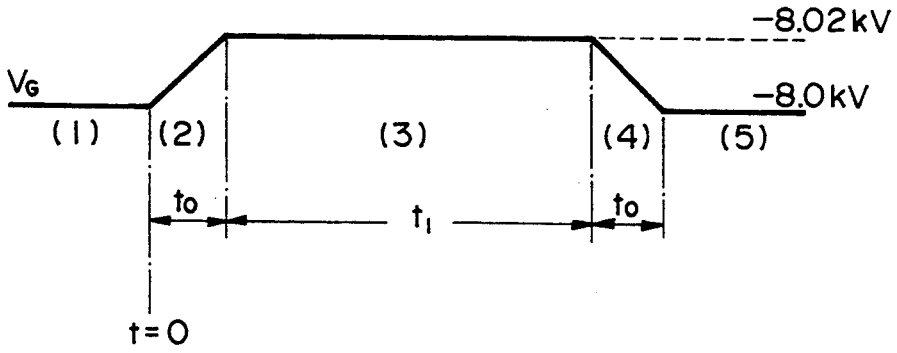
FIG. 13 is a view of changes of a gate voltage to be applied to the acceleration electrode.

FIG. 12 shows a sectional view of the imaging device according to a fifth embodiment of this invention. In this embodiment, the photocathode 2 has a constant potential, and a high speed shuttering operation is enabled by changing a potential of the acceleration electrode 5, as is in the previous embodiments. As shown in FIG. 12, a −10 kV-voltage is applied to the photocathode 2, and an anode 8 is grounded. A gate voltage $V_G$ shown in FIG. 13 is applied to the acceleration electrode 5. That is, in a region (1) up to a time t=0, the gate voltage is VG=−8.0 kV. In a region (2) the gate voltage is changed between VG=−8.0 and −8.02 kV. In a region (3), the gate voltage is constant, VG=−8.02 kV, and in a region (4), the gate voltage is changed between VG=−8.02 and −8.0 kV. In a region (5), the gate voltage is constant, VG=−8.0 kV.

Based on the electrode layout and the voltage distribution of FIGS. 12 and 13, the photoelectrons incident on the energy filter 9 will be explained. Photoelectrons which have been emitted from the photocathode 2 and passed through the anode 8 in the constant-voltage regions (1), (3) and (5), where a pulse voltage does not change, are not energized by the pulse voltage. Then the photoelectrons are incident on the energy filter 9 with energy determined by potentials of the photocathode 2 and the input surface of the energy filter 9. The energy E is E=10 keV.

On the other hand, the photoelectrons emitted from the photocathode 2 are modulated by pulse voltages in the regions (2) and (4), where the voltage changes. For example, $L_1$, $L_2$, $t_0$ and $t_1$ are so set that photoelectrons are emitted from the photocathode 2 at t=0, then pass through the acceleration electrode 5 at $t=t_0$, and pass through the anode 8 at $t<t_0+t_1$. A velocity $v_1$, at which the photoelectrons pass through the acceleration electrode 5 is derived as follows when an electric charge is represented by e, and its mass is denoted by m.

$$\begin{aligned} a &= dv/dt \\ &= (e/m)\cdot(1/L_1)\cdot\{2000-(20/t_0)t\} \\ v_1 &= (e/mL_1)\cdot(2000t_0-20t_0/2) \\ t_0 &= L_1(m/e)^{\frac{1}{2}}\cdot(3/2990)^{\frac{1}{2}} \end{aligned}$$

therefore, $$v_1=(e/m)^{\frac{1}{2}}\cdot(3/2990)^{\frac{1}{2}}$$

Upon finally entering the energy filter 9, these photoelectrons are further accelerated by 8.02 keV. The final energy $E_l$ of the photoelectrons is given by $$\begin{aligned} E_1 &= mv_1^2/2e + 8.02\times10^3\ (\text{eV}) \\ &= 10.007\ (\text{keV}). \end{aligned}$$

Thus, photoelectrons which have been emitted from the photocathode 2 in the region (2) and passed through the anode 8 are finally modulated by the pulse voltage (and obtain energy). On the other hand, photoelectrons which have been emitted from the photocathode 2 in the region (4) and passed through the anode 8 are deenergized by the pulse voltage and lose energy.

Accordingly when the energy filter 9 passes a photoelectron having an energy E over 10.000 keV, an image is formed by a shutter time corresponding to a time of the region 2. When the energy filter 9 passes photoelectron having energy E lower than 10.000 keV an image is formed by a shuttering time corresponding to a time of the region 4.

Figure 14:
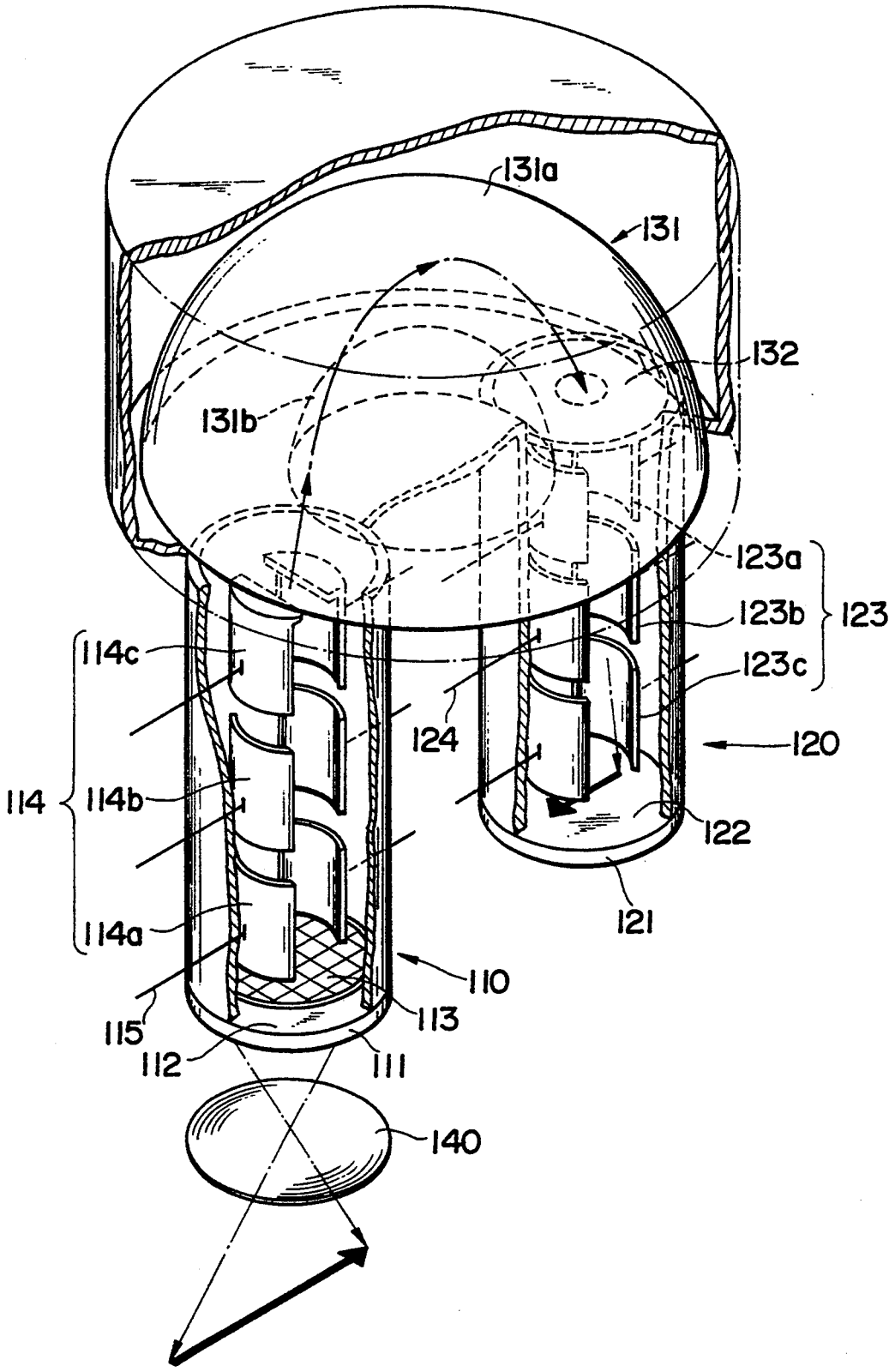
FIG. 14 is a perspective view of the imaging device according to a sixth embodiment of this invention.

FIG. 14 shows a perspective view of the imaging device, a shutter tube, according to a sixth embodiment of this invention. As shown in FIG. 14, the shutter tube according to the sixth embodiment has a shape of two cylindrical portions and a large cylindrical portion mounted on the cylindrical portions. The shutter tube is an vacuum part as a whole. One of the cylindrical portions includes an input unit 110 for receiving light from the outside and converting the light into photoelectrons. The other cylindrical portion includes an output unit 120 for producing a photoelectric image only during a gate period. The cylindrical portion includes concentric spheric ball-shaped electron energy analyzer (hereinafter called energy analyzer) 131 as shown in FIG. 14, and an electron beam gate electrode 132 having an aperture having a 3.5 mm-diameter, the aperature takes for taking out only photoelectrons having a predetermined energy.

The input unit 110 includes a light incident window 11 provided on the bottom of the cylindrical portion, a 10 mm-effective diameter photocathode 112 disposed inside surface of the light incident window 111, an acceleration electrode 113 disposed opposed to the photocathode 112, and a focusing electron lens 114 including $G_1$ electrode **114*a*, a $G_2$ electrode 114*b* and a $G_3$ electrode 114*c* disposed between the acceleration electrode 113 and the energy analyzer 131. These members are positioned along the axis of the cylindrical container. A gap between the photocathode 112 and the acceleration electrode 113 is 5 mm, and a spacing from the photocathode 112 to the energy analyzer 131** is about 150 mm.

The output unit 120 comprises a light emitting window 121 disposed on the bottom of the cylindrical container, a fluorescent surface 122 disposed on the inside surface of the light emitting window 121, a focusing electron lens 123 including a $C_4$ electrode **123*a*, a $G_5$ electrode 123*b*, a $G_6$ electrode 123*c* disposed between the light emitting window 121 and the energy analyzer 131**. These members are positioned along the axis of the cylindrical container.

The energy analyzer 131 includes two semi-spherical electrode plates **131*a*, 131*b* having a common center, and different radii from each other. The inside surface of the electrode plate 131*a* and the outside surface of the electrode plate 131*b* function an electron passage for photoelectrons to pass through. The radius of the semi-spherical electrode plate 131***a* is 65 mm, and the radius of the electrode plate 131*b* is 50 mm. The inner diameter of the electrodes of the respective focusing electron lenses 114, 123 are about 30 mm. The respective electrodes of the focusing electron lenses 114, 123 are supported in the respective container, insulated therefrom. Lead wires 115, and 124 for respectively applying voltages to the focusing electron lens 114 and 123 are led outside with the vacuum secured.

The acceleration electrode 113 and the $G_1$ electrode 114*a* are electrically connected to each other in the tube.

The operational principle of the shutter tube of the above-described structure will be explained with reference to the sectional view of FIG. 15. Light to be measured is incident on the light incident window 111 through a lens 140 disposed outside the light incident window 111 and forms an image on the photocathode 112. The light to be measured is reflected by a half mirror 141 to be supplied to a PIN photodiode 142. In response to the incident light the PIN photodiode 142 outputs a trigger signal. A delay circuit 143 delays this trigger signal by a suitable time and supplies the trigger signal to a slope voltage generating circuit 144. In response to the trigger signal the slope voltage generating circuit 144 generates a slope voltage. This slope voltage is multiplexed with a d.c. voltage to be applied to the photocathode 112. A delayed timing of the trigger signal is adjusted by the delay circuit 143 so as to make an incident timing of an object to be imaged identical thereto, whereby a shutter timing can be set for a very short shutter time. The sixth embodiment can provide an about 100 ps-shutter time, and no blurred output image is formed.

The slope voltage generating circuit 144 generates a voltage having an inclined leading portion and trailing portion of which voltage changes in 10 ns between −1.5 kV and +1.5 kV. The d.c. voltage applied to the photocathode 112 is −8 kV. Accordingly the photocathode 112 is supplied with a voltage which changes in 10 ns between −9.5 kV and −6.5 kV.

The light to be measured forms an image on the photocathode 112, and photoelectrons corresponding to a light amount of the light to be measured are emitted from the photocathode 112. The photoelectrons are accelerated by the acceleration electrode 113 with a −5 kV-voltage applied to. But the value of the photocathode voltage is transient as described above, and acceleration energy applied to the photoelectrons is accordingly changed.

The photoelectrons are focused by the focusing electron lens 114 to be input to the energy analyzer 131. A −5 kV voltage is applied to the $G_1$ electrode 141*a* of the focusing electron lens 141, and a 0 V-voltage (ground voltage) is applied to the $G_3$ electrode 114*c*. The $G_2$ electrode 114*b* is supplied with a voltage of 0 V to −8 kV adjusted by a variable resistor 145. Energy of the photoelectrons at the time of their incidence on the energy analyzer 131 corresponds to a potential difference between the photocathode 112 and the $G_3$ electrode 114*c*. But this energy is transient, because the voltage value of the photocathode 112 is transient.

A suitable d.c. voltage is applied between the electrode plate 131*a* of the energy analyzer 131 and the electrode plate 131*b*, and the outer electrode plate 131*a* has a lower potential than the inner electrode plate 131*b*. Accordingly the photoelectrons incident on the energy analyzer 131 are deflected clockwise. In the sixth embodiment, the electrode plates 131*a*, 131*b* are supplied respectively with d.c. voltages of negative and positive polarities. An electron beam gate electrode 132 is supplied with a 0 V-voltage (ground voltage).

Consequently those of the photoelectrons dispersed by the energy analyzer 131 which have certain energy which allows them to depict an orbit passing through an opening of the electron beam gate electrode 132. That is, the photoelectrons emitted from the photocathode 112 transiently have different energy. Resultantly those of the photoelectrons corresponding to a short-time region can be taken out.

The photoelectrons which have passed through the opening of the electron beam gate electrode 132 are focused by the focusing electron lens 123 to form an image on the fluorescent surface 122, and a visible optical image can be provided from the light emitting window 121. At this time, a 0 V-voltage is applied to the $G_4$ electrode 123*a* and the $G_5$ electrode 123*c* of the focusing electron lens 123, and the fluorescent surface 122. The $G_6$ electrode 123*b* is supplied with a voltage which has been adjusted by the variable resistor 146 to satisfy required conditions.

Next, the operation of the sixth embodiment will be explained with reference to the sectional view of FIG. 16.

Figure 16:
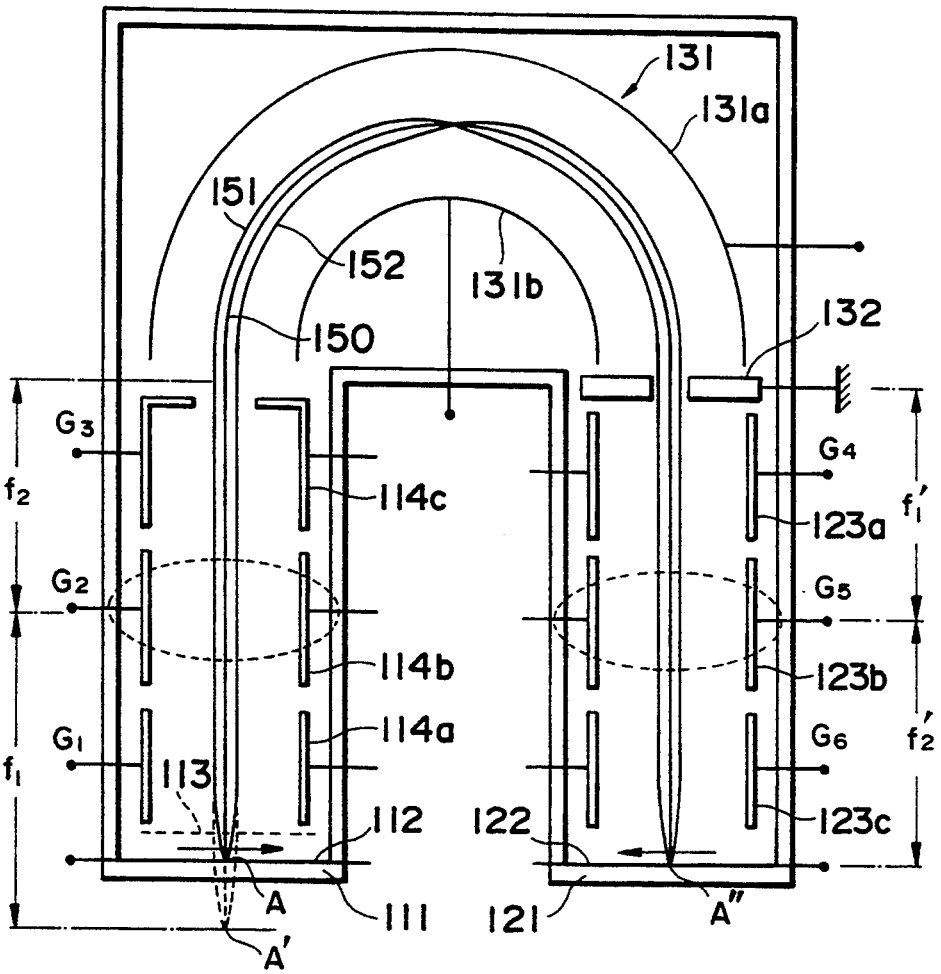
FIG. 16 is a sectional view of the imaging device according to the sixth embodiment which is explanatory of its operation.

FIG. 16 is intended to show especially by means of the process of forming an optical image how a photoelectronic image corresponding to an optical image formed on the photocathode 112 is formed in an optical image on the fluorescent surface 122. Photoelectrons are emitted from the photocathode 112 at an initial velocity distribution. For example, when visible light is incident on the photocathode of Specification S-20, its energy is 0∼1 eV, and its peak is at about 0.5 eV. The distribution of the emission angles is a substantially cosine distribution having a peak in the vertical direction. FIG. 16 shows orbits of the photoelectrons emitted in such distribution from the central point A of the photocathode 112. Here the main orbit 150 of photoelectrons emitted at a 0-initial velocity, and $\beta$ orbits 151, 152 of photoelectrons emitted at suitable angles and velocity on both sides of the vertical line to the photocathode 112 are noted. The photoelectrons on the $\beta$ orbits 151, 152 are accelerated by a uniform acceleration electric field between the photocathode 112 and the acceleration electrode 113, and depict parabolic orbits to enter the $G_1$ electrode 114*a*. The photoelectrons advance substantially straight in the neighborhood of the acceleration electrode 113 of the $G_1$ electrode 114*a* because in the neiborhood of the acceleration electrode 113 the electric field is weaker. When the two $\beta$ orbits 151, 152, and the main orbit 150 are extended backward toward the photocathode 112, these orbits intersect one another at a point on the side of the light incident surface of the photocathode 112. It is found that there is a virtual image point A'.

In the sixth embodiment, a forward focal point of the focusing electron lens 114 constituted by the $G_1$ electrode 114*a*, the $G_2$ electrode 114*b* and $G_3$ electrode 114*c* is in agreement with the virtual image point A' of an electron optical object point of a photoelectric image emitted from the photocathode 112. At the same time, a rearward focal point of the focusing electron lens 114 is in agreement with an object point of the electron lens constituting the energy analyzer 131 (near the entrance of the energy analyzer 131). They are brought into agreement by suitably adjusting physical configurations of the respective electrodes, and a layout thereof, especially a gap between the photocathode 112 and the G2 electrode 114*b*, and a gap between the $G_2$ electrode 114*b* and the entrance of the energy analyzer 131, a d.c. voltage to be applied to these electrodes and also by adjusting by the variable resistor 145 a voltage to be applied to the $G_2$ electrode 114*b*. Resultantly since the virtual image point A' is located at the forward focal point of the focusing electron lens 114, the $\beta$ orbits 151, 152 are brought substantially parallel with the main orbit 150, and the photoelectrons on the $\beta$ orbits 151, 152 enter the energy analyzer 131 parallelly with the photoelectrons on the main orbit 150.

Next, orbits of the photoelectrons in the energy analyzer 131 will be explained. When a d.c. voltage applied between the outer electrode plate 131*a* and the inner electrode plate 131*b* is high, the photoelectrons are more curved and depict acute arcs. When a d.c. voltage applied between the outer electrode plate 131*a* and the electrode plate 131*b* is low, photoelectrons are not much curved and depict blunt arcs. While a slope voltage is not applied to the photocathode 112, the photocathode 112 is supplied only with a −8 kV-constant voltage, and the photoelectrons enter the energy analyzer 131 with 8 keV-energy. In accordance with this energy, a voltage between the electrode plates 131*a*, 131*b* is suitably adjusted. Then as shown in FIG. 16, the main orbit 150 depicts an arc intermediate between the electrode plates 131*a*, 131*b* of the energy analyzer 131, and arrive at the center of the opening of the photoelectron beam gate electrode 132. The $\beta$ orbits 151, 152 intersect the main orbit 150 once at the substantial center of the energy analyzer 131. That is, a real image is once formed here. The $\beta$ orbits 151, 152 again leave the main orbit 150 to be substantially parallel with the main orbit at the exit of the energy analyzer 131, i.e., near the electron beam gate electrode 132. The photoelectrons along the main orbit 150, and the photoelectrons along the $\beta$ orbits 151, 152 pass through the opening of the electron beam gate electrode 132 to the fluorescent surface 122.

The focusing electron lens 123 brings the forward focal point into agreement with an image point of the electron lens constituted by the energy analyzer 131, and at the same time a rearward focal point of the focusing electron lens 123 into a position of the fluorescent surface 122. To bring them into agreement, similarly with the focusing electron lens 114, the physical configurations of the respective electrodes, and a layout thereof, especially a gap between the exit of the energy analyzer 131 and the $G_5$ electrode 123*b*, and a gap between the $G_5$ electrode 123*b* and the fluorescent surface 122 are suitably adjusted, and in addition, a d.c. voltage to be applied to these electrodes, especially to the $G_5$ electrode 123*b* is adjusted to be as shown in FIG. 15, by the variable resistor 146.

The photoelectrons along the main orbit 150, and the photoelectrons along the $\beta$ orbits 151, 152 pass through the opening of the electron beam gate electrode 132 substantially parallelly with one another and enter the focusing electron lens 123. Since the rearward focal point of the focusing electron lens 123 is adjusted to be on the fluorescent surface 122, the photoelectrons form an image on the center A" of the fluorescent surface 122, and radiate.

For the sixth embodiment to function as a shutter tube, it is necessary that those of the photoelectrons emitted from the photocathode 112 which have been emitted in a required short-time region pass through the opening of the electron beam gate electrode 132. To this end, a voltage supplied to the photocathode 112 from a voltage generating circuit 144 is multiplexed with a −8 kV-voltage. The voltage changes a voltage of the photocathode 112 between −9.5 kV and −6.5 kV. Accordingly the energy of the photoelectrons changes from 9.5 keV to 6.5 KeV from the photocathode 112 to the energy analyzer 131. Accordingly those of the photoelectrons emitted from the point A during a short-time region, when about 8.0 keV is applied to the photocathode, can pass through the opening of the electron beam electrode 132. But when a voltage of the photocathode 112 is lower (at a larger negative value), the photoelectrons have higher energy and cannot be sufficiently curved in the energy analyzer 131. The photoelectrons impinge on the electron beam gate electrode 132 and absorbed, and cannot arrive at the fluorescent surface 122. And when a voltage of the photocathode 112 is higher (at a smaller negative value), the photoelectrons have lower energy and are more curved in the energy analyzer 131. The photoelectrons impinge on the electron beam gate electrode 132 and absorbed, and cannot arrive at the fluorescent surface 122. Only those of the photoelectrons which have been emitted from the photocathode 112 in a short-time region arrive at the fluorescent surface 122 and radiate. That is, a slope voltage generated by the slope voltage generating circuit 144 of FIG. 15 is multiplexed with a −8 kV-voltage applied to the photocathode 112, so that the photoelectrons are swept on the electron beam gate electrode 132. And a gate operation is conducted. Although the photoelectrons are thus swept, the orbits of the photoelectrons passing through the opening of the electron beam gate electrode 132 are parallel with one another (photoelectrons emitted form the central point A of the photocathode 112 are vertical to the surface of the electron beam gate electrode 132) even with the above-described layout of the electron lens system and under the above-described operational conditions, and form an image at the rearward focal point of the focusing electron lens 123. the position of the image on the fluorescent surface 122 is the center of the fluorescent surface 122 (an intersection between the axis of the container and the fluorescent surface film 122).

Figure 17:
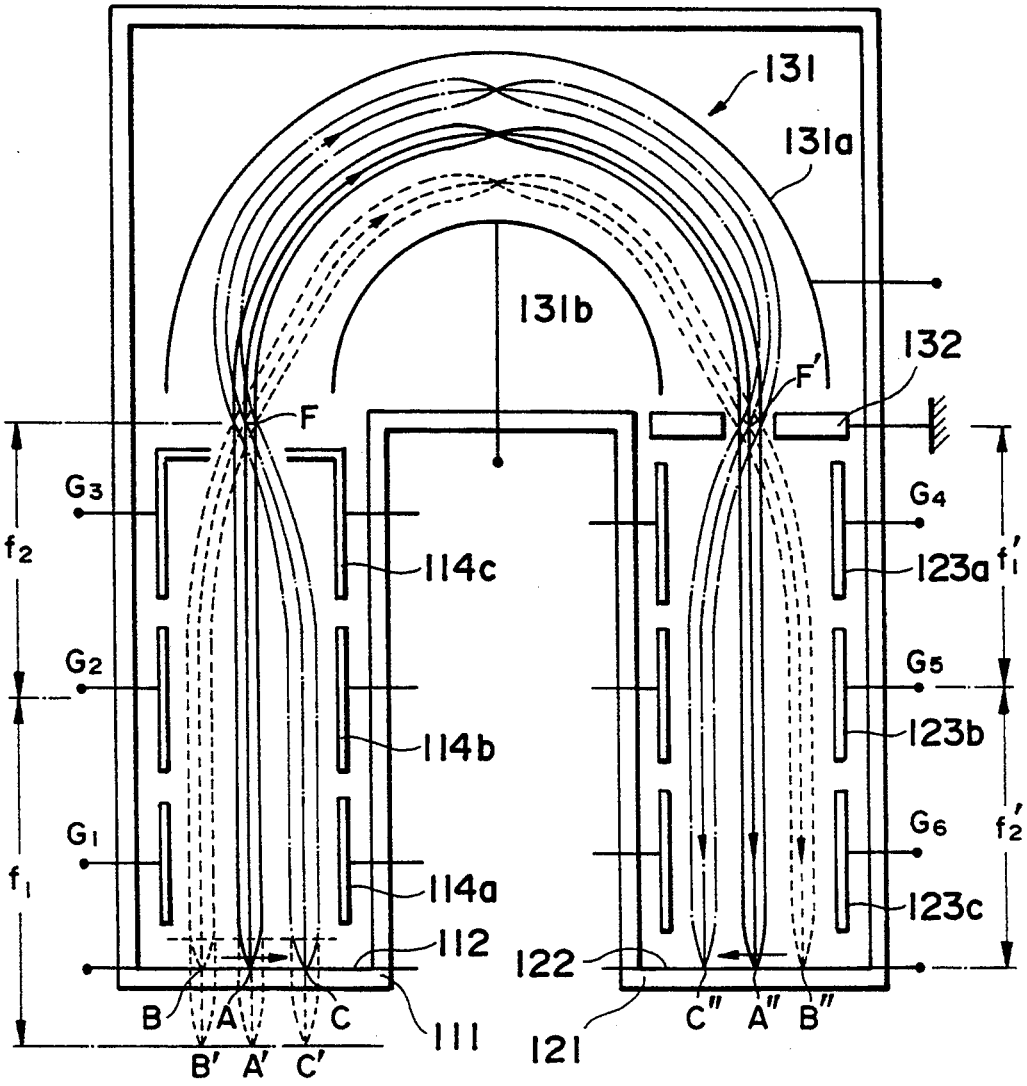
FIG. 17 is a sectional view of the imaging device according to sixth embodiment which is explanatory of a plurality of orbits of the photoelectrons.

Next, orbits of photoelectrons emitted from a plurality of points on the photocathode 112 will be explained with reference to FIG. 17. Three main orbits of the photoelectrons are vertical to the photocathode 112 because the initial velocity of the photoelectrons is 0, and are incident on the focusing electron lens 114 in the orbits which are parallel with one another. The orbits intersect with one another at a point F which is a rearward focal point. $\beta$ orbits of photoelectrons emitted from the points B and C depict parabolic orbits near their main orbits between the photocathode 112 and the acceleration electrode 113 as in FIG. 16, and form virtual images B', C' on the side of the light incident surface of the photocathode 112. The $\beta$ orbits are brought parallel with their main orbits by the focusing electron lens 114 and arrive at the point F. Then in the energy analyzer 131, a constant voltage of −8 kV is applied to the photocathode 112 so that the orbits from the point A pass through the opening of the electron beam gate electrode 132. Since the point F is an object point of the electron lens constituting the energy analyzer 131, an image formed by the main orbits intersecting with one another at the point F is formed on the exit of the energy analyzer 131, i.e., at the central point F' of the opening of the electron beam gate electrode 132. At the point F', angles formed by the main orbits from the points B, C to the main orbit from the point A have the same absolute values as those at the point F, but their polarity are opposite. The $\beta$ orbits from the points B, C are parallel with their main orbits Then at the point F', which is a forward focal point of the focusing electron lens 123, the main orbits from the points B, C pass through the focusing electron lens 123 and then arrive at point B'' and C'' on the fluorescent surface 122 in parallel with the main orbit from the point A. The $\beta$ orbits from the points B, C also arrive respectively at the points B'', C'' and form at the points B', C'' optical images corresponding to the points B, C on the photocathode 112.

As described above, with the photocathode 112 supplied only with a $-8$ kV voltage, photoelectrons pass through the energy analyzer 122 and form on the fluorescent surface an optical image corresponding to an optical image on the photocathode 112. When a slope voltage is applied to the photocathode 112, the photoelectrons emitted from the points B, C swept on the electron beam gate electrode 132, and photoelectrons corresponding to a short-time region pass through the opening of the electron beam gate electrode 132. Thus framing images can be formed on the fluorescent surface 122. The above-described explanation makes it understandable that it is an essential condition for the photoelectrons to pass through the opening of the electron beam gate electrode 132 that the main orbits from the points A, B, C are converged on one point in the opening of the electron beam gate electrode 132. That is, the photoelectrons from the photocathode 112 are swept on the electron beam gate electrode 132, but a shutter time for the photoelectrons is determined by beam diameters of the photoelectron beams, a sweep speed, and a size of the opening of the electron beam gate electrode 132. To make a shutter time short, it is necessary to make a beam diameter of the photoelectrons small. This is because a sectional diameter of a total beams of the photoelectrons (including the $\beta$ orbits) from the photocathode 112 is minimum at the point where the main orbits from the photocathode 112 gather.

Next, an application of the sixth embodiment to a case that an object to be observed during a gate period Ta incessantly emits light to be measured will be explained with reference to FIG. 18.

Figure 18:
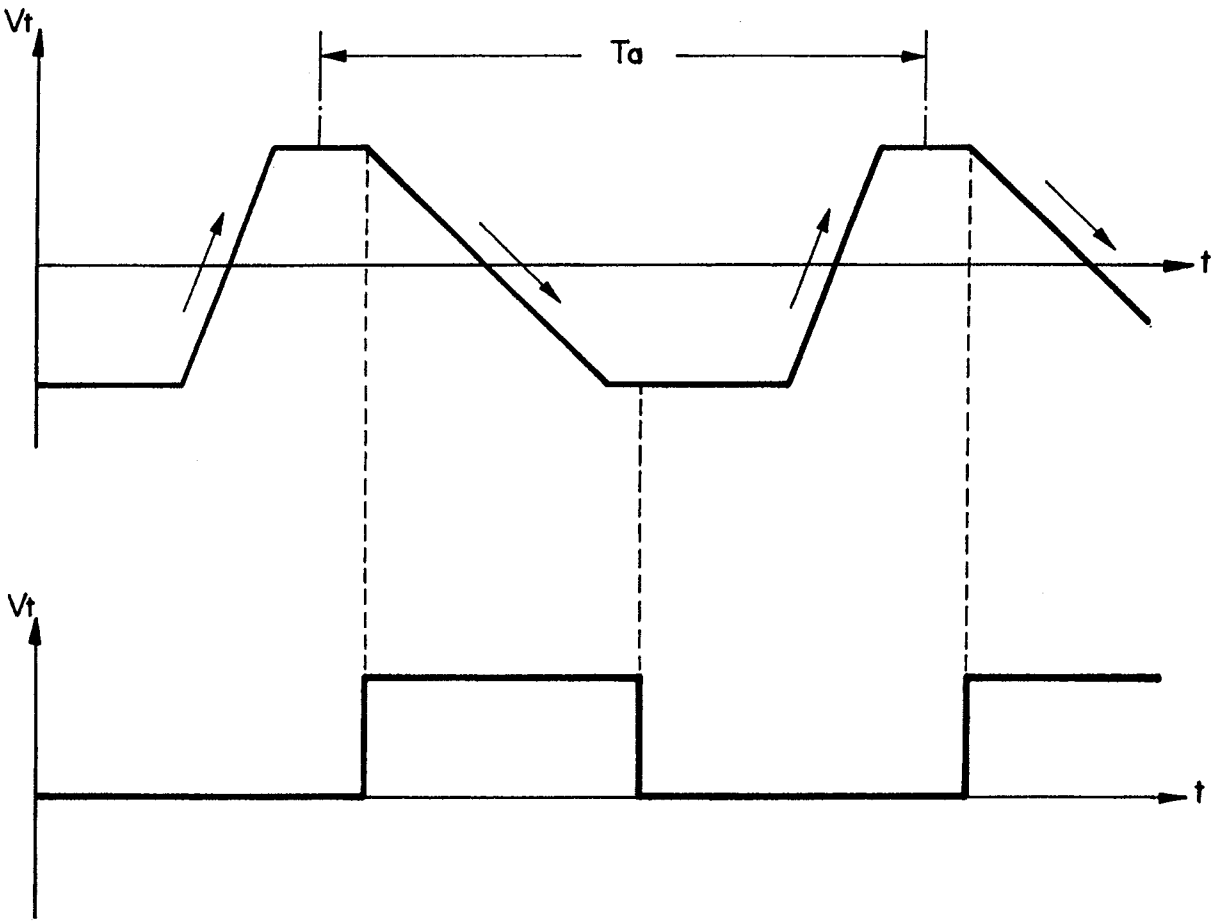
FIG. 18 is a waveform view of a slant voltage to be applied to the photocathode.
Figure 19:
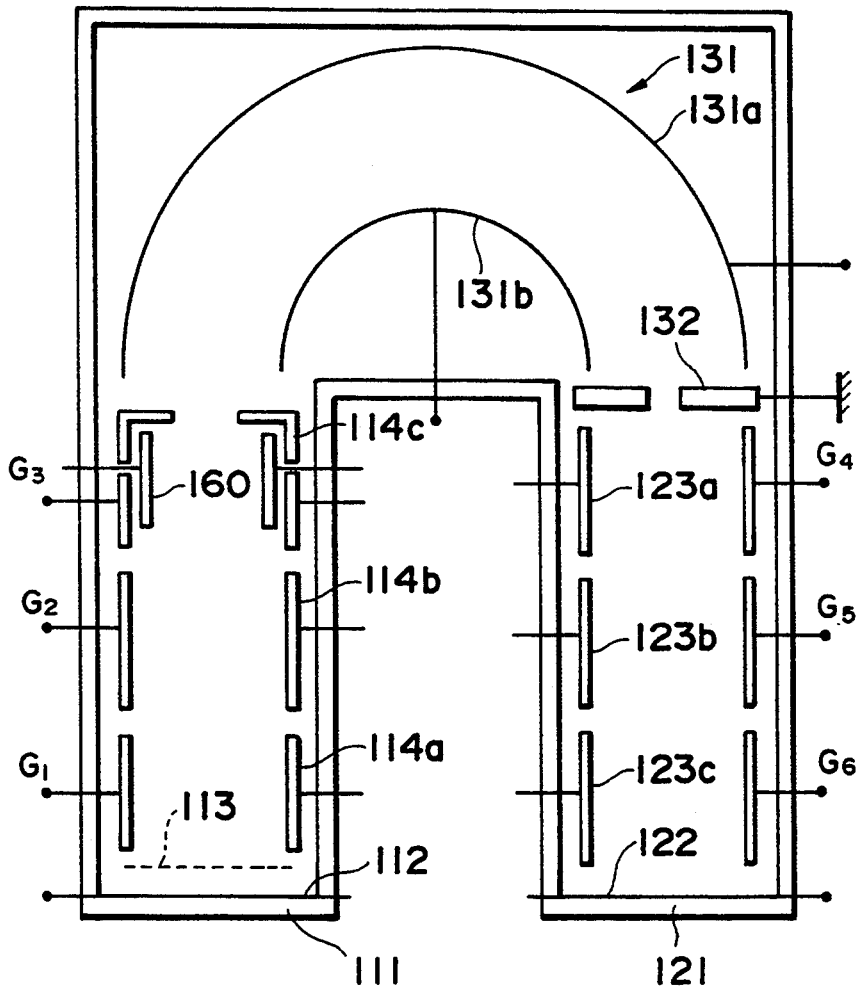
FIG. 19 is a sectional view of one example of the sixth embodiment in which an electrode $G_3$ includes a polarized electrode.

In FIG. 18, the upper view is a voltage waveform of a phenomenon that a slope voltage is repeatedly applied to the photocathode 112. The lower view shows a pulse voltage waveform to be applied to a deflecting electrode 160 see FIG. 19.

In the case of the phenomenon that an object to be observed emits light to be measured, a transient slope voltage is repeatedly applied to the photocathode 112 synchronously with the emission of light, whereby a visible optical image can be repeatedly formed on the fluorescent surface 122 corresponding to an optical image to be measured through a short-time region of the same phase. The visible optical images are taken by TV cameras or other means, and their image signals are integrated to much improve an S/N ratio of the image. A repeatedly applied slope voltage may be sine wave voltages.

In the case that a voltage to be applied to the photocathode 112 has inclined leading portions and inclined trailing portions as shown in FIG. 18, the photoelectrons which have passed through the energy analyzer 131 are repeatedly and reciprocally swept on the electron beam gate electrode 132. Accordingly the photoelectrons pass through the opening of the electron beam gate electrode 132 twice per one period of reciprocal swept (once on the go trip, and once on the return trip). In this case, a period of a voltage is identical to a period of an object to be imaged, and it is necessary that photoelectrons reach the fluorescent surface 122 only at one inclination of the voltage. To this end, a deflecting electrode 160 is provided in, e.g., the $G_3$ electrode **114*c* for applying a deflecting voltage to the deflecting electrode 160 at a timing of passage of photoelectrons of an unnecessary inclined portion of the voltage. The application of the deflecting voltage deflects the photoelectrons to hinder the advance of the photoelectrons by the electron beam gate electrode 132. Accordingly these photoelectrons do not arrive at the fluorescent surface 122. Deflecting electrodes 160 may be additionally provided in the $G_1$ and $G_4$ electrodes 114*a*, 123*a***.

In place of additionally providing the deflecting electrode 160, a pulse voltage is applied at the same timing as applied to the deflecting electrode 160 to be multiplexed with a d.c. voltage between the outer electrode plate **131*a* of the energy analyzer 131 and the inner electrode plate 131*b* thereof, whereby the photoelectrons of an unnecessary polarity cannot pass through the opening of the electron beam gate electrode 132. Furthermore, by changing, in terms of time, a timing of the application of the slope voltage to the photocathode 112, virtual optical images can be formed on the fluorescent surface 122** corresponding to optical images to be measured for different short-time regions.

The energy analyzer 131 used in the shutter tube according to the sixth embodiment is described in "Nuclear Instruments and Methods in Physics Research", A291 (1990), p. 60–66.

Figure 20:
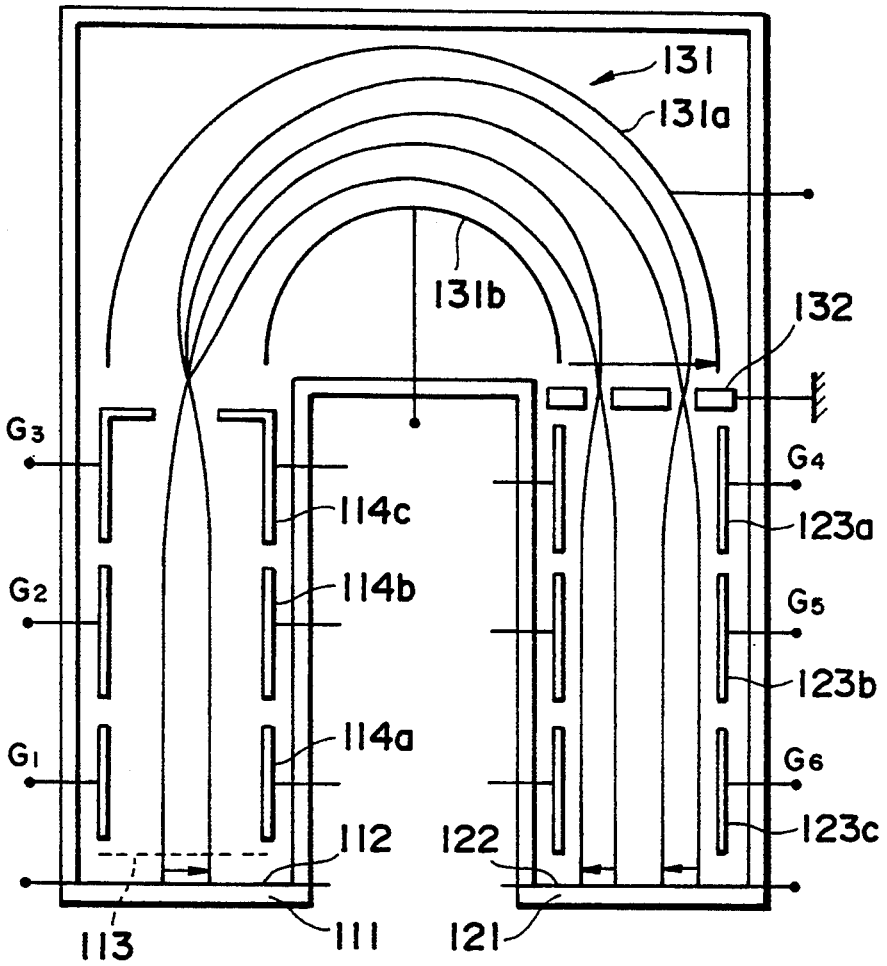
FIG. 20 is a sectional view of one variation of the sixth embodiment.

Next a seventh embodiment will be explained with reference to sectional views of FIGS. 20 and 21. A difference of the shutter tube of FIG. 20 from that of FIG. 14 is that a plurality of openings are provided in the electron beam electrode 132. Accordingly, when a transient slope voltage is once applied to the photocathode 112, virtual optical images can be formed on the fluorescent surface 122 corresponding to a measured optical image for different short-time regions.

Figure 21:
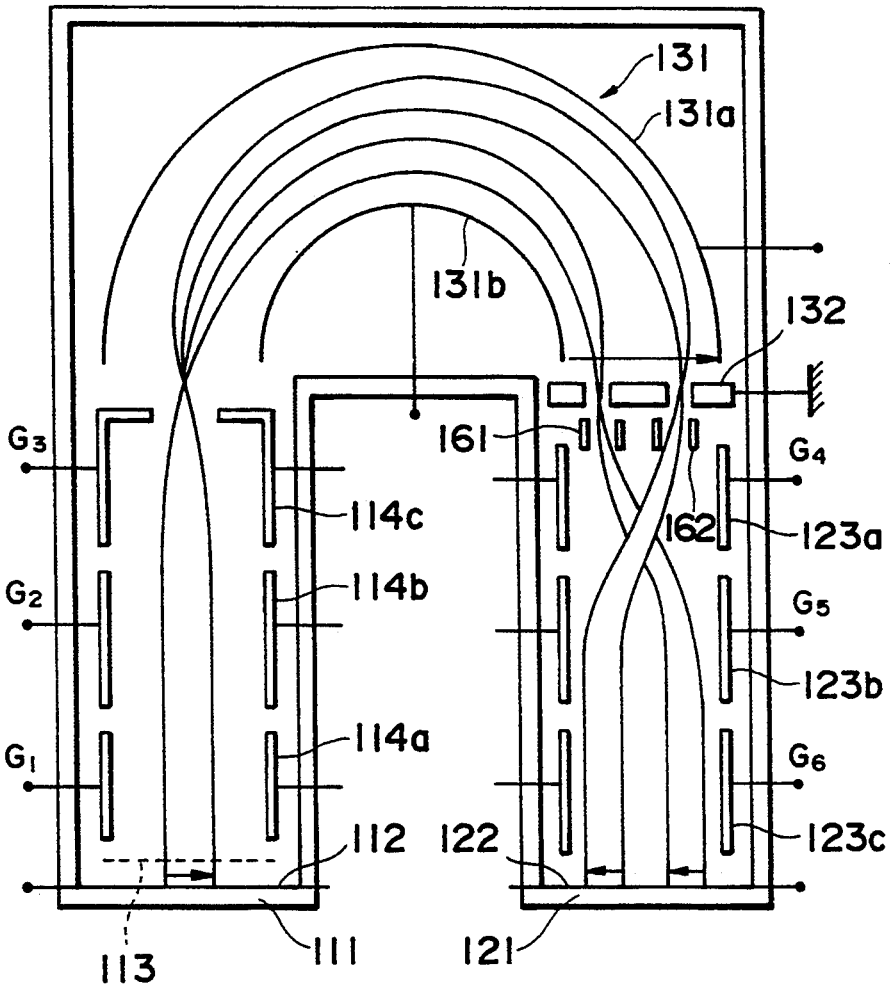
FIG. 21 is a sectional view of the imaging device according to a seventh embodiment of this invention.

The shutter tube of FIG. 21 includes an electron beam gate electrode 132 having a plurality of openings, and deflecting electrodes 161, 162 disposed on the side of the opening of the electron beam gate electrode 132. A d.c. voltage is applied to the deflecting electrodes 161, 162 so that the photoelectrons which have passed through the openings in the electron beam gate electrode 132 are directed substantially to the center of a focusing electron lens 123, whereby the photoelectrons are passed through the central portion of the focusing electron lens 123. Accordingly less spherical aberration takes place in the focusing electron lens 123, and improved image quality can be obtained.

In a modification of the seventh embodiment, a plurality of focusing lenses may be provided between the photocathode 112 and the focusing electron lens 114, whereby a photoelectric image on the photocathode 112 is formed at the forward focal point of the focusing electron lens 114.

In the respective embodiments, the acceleration electrode 113 is provided by a mesh-type electrode, but may be provided by a cylindrical ring, or a plate electrode having a round opening. In place of the fluorescent surface 122 CCD capable of receiving electrons may be used as the output surface.

The focusing lenses 114, 123, and a plurality of focusing lenses used between the photocathode 112 and the focusing lenses 114 in the above-described modification may be provided by electromagnetic focusing coils in place of static focusing electrodes.

Figure 15:
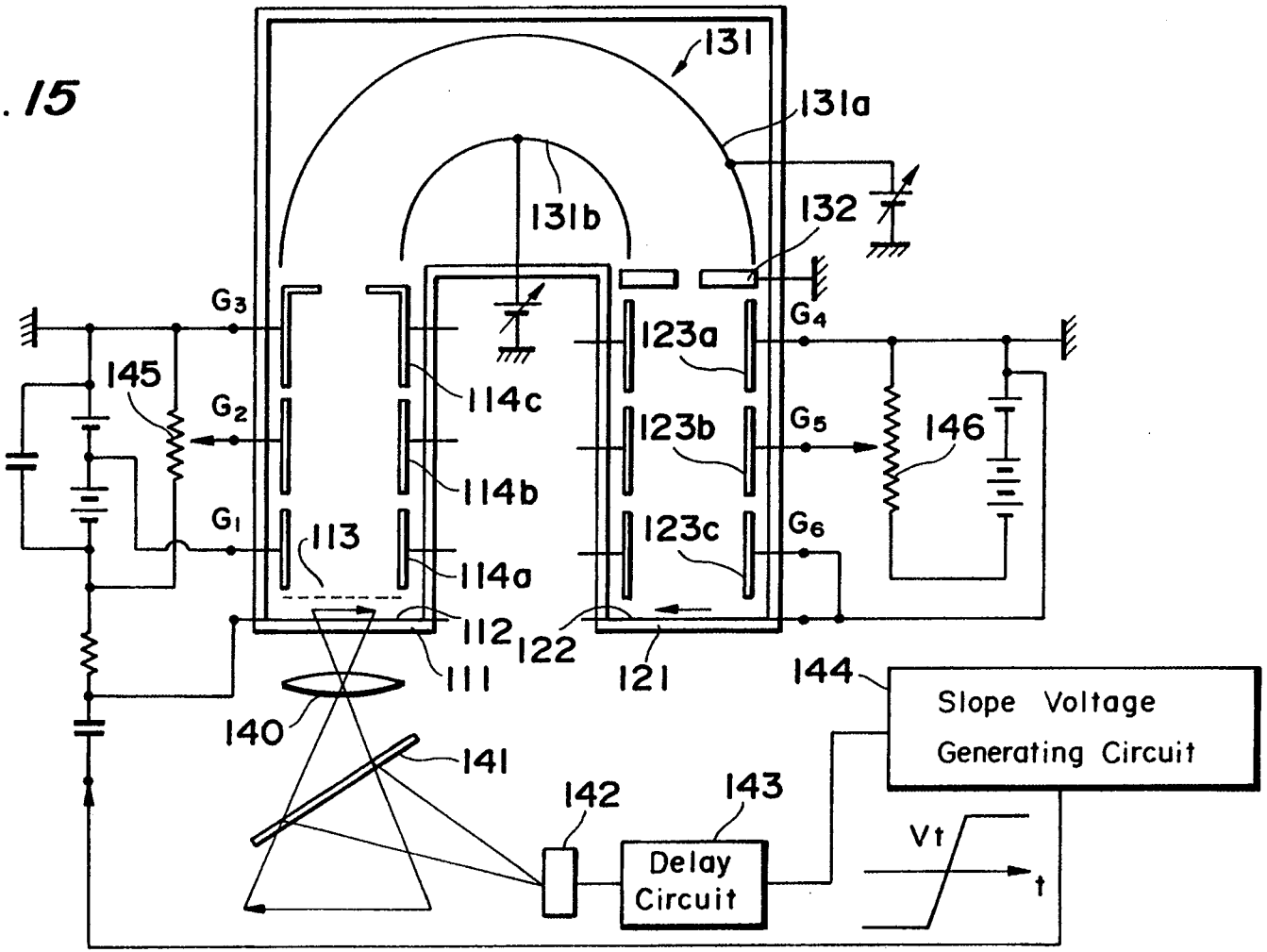
FIG. 15 is a sectional view of the imaging device according to the sixth embodiment.

The transient slope voltage to be applied to the photocathode 112 in FIG. 15 transiently increases in the positive direction of potential, but may be increased oppositely in the negative direction. In this case, photoelectrons are swept oppositely on the electron beam gate electrode 132.

Figure 22:
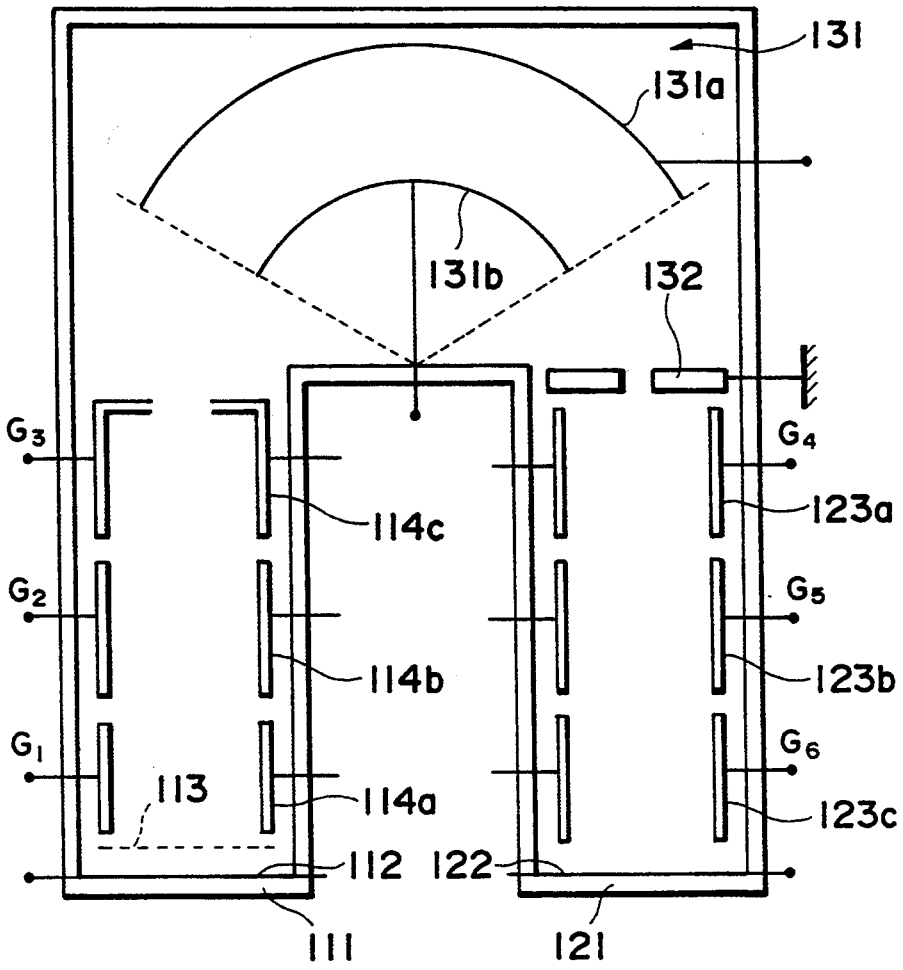
FIG. 22 is a sectional view of variations of the sixth and the seventh embodiments.

In the sixth and the seventh embodiments, the energy analyzer 131 is provided by sector 180°-divided balls (semispheres), but as shown in FIG. 22, may be provided by conical balls divided by an angle other than 180°.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An imaging device for forming an image of an object to be imaged at a predetermined shutter timing comprising:

a photocathode for emitting photoelectrons in accordance with incident light for said object to be imaged;

an acceleration electrode, of an electron-transmitting type, opposed to said photocathode and having a positive potential with respect to said photocathode;

power source means for changing a photocathode potential in a set range from a constant level in synchronization with said shutter timing;

an energy filter, disposed on the opposite side of the photocathode and across from said acceleration electrode, for blocking photoelectrons from said photocathode at said constant level, and for passing photoelectrons emitted from said photoelectrode when said photocathode potential is changed by a required value within said set range; and an output plate for said photoelectrons which have passed through said energy filter to be incident upon.

2. An imaging device according to claim 1, wherein:

said power source means is for lowering, by said required value, said photocathode potential difference from said constant level, and then returning said lowered level to said constant level; and said energy filter passes said photoelectrons from said photocathode only when said photocathode potential is lower than said constant level by said required value.

3. An imaging device according to claim 2, wherein:

said energy filter includes two electron transmitting-type electrodes, one of said two electrodes on the side of said output plate has a negative potential to the other, and said two electrodes have a potential difference of $E_F$; and $$E_C<E_F<E_C+E_B$$

is given when said constant level is represented by $E_C$, and said required value is represented by $E_B$.

4. An imaging device according to claim 1, wherein:

said power source is for increasing, by said required value, said photocathode potential difference from said constant level in synchronization with said shutter timing; and said energy filter transmits said photoelectrons from said photocathode only when said photocathode potential exceeds said constant level by said required value but does not reach a level up to which said constant level has been increased by said required value.

5. An imaging device according to claim 4, wherein said energy filter includes:

first means for prohibiting transmission of said photoelectrons from said photocathode with said potential at said constant level; and second means for prohibiting transmission of said photoelectrons emitted from said photocathode with said photocathode potential increased by said required value.

6. An imaging device for forming an image of an object to be imaged at a set shutter timing comprising:

a photocathode applied with a constant potential for emitting photoelectrons corresponding to incident light from said object to be imaged;

an electron transmitting-type acceleration electrode disposed opposite to said photocathode;

a power source for changing a voltage to be applied to said acceleration electrode within a set range between a first level and a second level in synchronization with said shutter timing;

an anode with a constant positive potential to said photocathode;

an energy filter, disposed on the opposite side of said photocathode across from said acceleration electrode, for transmitting said photoelectrons emitted from said photocathode only while the applied voltage to said acceleration electrode is increasing or decreasing; and an output surface for said photoelectrons which have been passed through said energy filter to be incident upon.

7. An imaging device for forming an image of an object to be imaged at a predetermined shutter timing comprising:

a photocathode for emitting photoelectrons in accordance with incident light of said object to be imaged; an acceleration electrode, of a photoelectron transmitting type, for accelerating said photoelectrons, said acceleration electrode being disposed opposed to said photocathode;

power source means for changing a photocathode potential from a constant level within a predetermined range in synchronization with said shutter timing;

a first electron lens system for focusing said photoelectrons accelerated by said acceleration electrodes;

energy analyzing means, including two divided-spherical electrodes having different radii and a common center, for passing said photoelectrons focused by said first electron lens system and for deflecting said photoelectrons, which have selected energies, said energy analyzing means having an opening for passing said photoelectrons along a predetermined orbit;

a second electron lens system for forming an image of said photoelectrons which have passed through said opening; and an output surface for outputting a photoelectronic image formed by said second electron lens system, said first electron lens system being arranged so that one focal point and a position at which a virtual image of said photoelectrons emitted from said photocathode is formed are brought into agreement with each other, while bringing the other focal point and an object point of an electron lens, constituted by said energy analyzing means, into agreement with each other;

said second electron lens system being arranged so that one focal point and an image point of an electron lens constituted by said energy analyzing means are brought into agreement with each other, while bringing the other focal point and a position, where said output surface is disposed, into agreement with each other.

8. An imaging device according to claim 7, wherein said opening has a plurality of openings.

9. An imaging device according to claim 8, wherein deflecting electrodes are disposed between said openings and said second electron lens system, and said deflecting electrodes are supplied with a voltage so that said photoelectrons which have passed through said openings are directed substantially to the center of said second electron lens system.

* * * * *